US007521407B2

(12) United States Patent
Tamura

(10) Patent No.: US 7,521,407 B2
(45) Date of Patent: Apr. 21, 2009

(54) REMOVER COMPOSITION

(75) Inventor: Atsushi Tamura, Wakayama (JP)

(73) Assignee: KAO Corporation, Tokyo (JP)

( * ) Notice: Subject to any disclaimer, the term of this patent is extended or adjusted under 35 U.S.C. 154(b) by 689 days.

(21) Appl. No.: 11/289,457

(22) Filed: Nov. 30, 2005

(65) Prior Publication Data

US 2006/0122083 A1 Jun. 8, 2006

(30) Foreign Application Priority Data

Dec. 7, 2004 (JP) ..... 2004-353588
Dec. 7, 2004 (JP) ..... 2004-353591

(51) Int. Cl.
*C11D 7/32* (2006.01)

(52) U.S. Cl. ..... 510/175; 510/176; 134/1.3

(58) Field of Classification Search ..... 510/175, 510/176; 134/1.3
See application file for complete search history.

(56) References Cited

U.S. PATENT DOCUMENTS 4,473,505 A * 9/1984 Mitchell, III ..... 556/15
4,522,932 A * 6/1985 Mitchell, III ..... 502/153
4,906,541 A * 3/1990 Dust et al. ..... 430/49.43
5,069,991 A * 12/1991 Leyrer et al. ..... 430/49.46
6,929,895 B2 * 8/2005 Maemoto et al. ..... 430/138
2003/0148207 A1 * 8/2003 Maemoto et al. ..... 430/138
2004/0142835 A1 7/2004 Takashima
2006/0122083 A1 * 6/2006 Tamura ..... 510/175
2007/0060490 A1 * 3/2007 Skee ..... 510/175

OTHER PUBLICATIONS

English language abstract of JP 2003068699 (Mar. 7, 2003).

* cited by examiner

*Primary Examiner*—Gregory E Webb
(74) *Attorney, Agent, or Firm*—Birch, Stewart, Kolasch & Birch, LLP

(57) ABSTRACT

A remover composition used for cleaning of a semiconductor substrate or semiconductor element, wherein (1) the remover composition contains 65% by weight or more of water; (2) the remover composition has a pH at 20° C. of 2 or more and 6 or less; and (3) the remover composition contains (I) at least one member selected from the group consisting of a saccharide, an amino acid compound, an organic acid salt and an inorganic acid salt, and 0.01 to 1% by weight of ammonium hexafluorosilicate, or (II) an organic phosphonic acid and a fluorine-containing compound. The remover composition of the present invention can be suitably used for manufacturing high-quality electronic parts such as LCD, memory, and CPU.

14 Claims, No Drawings

REMOVER COMPOSITION

FIELD OF THE INVENTION

The present invention relates to a remover composition used for removing a resist residue that remains after a resist used in a step of forming a semiconductor element on a semiconductor substrate such as a silicon wafer is removed by ashing, and a metal oxide product derived from metal line (the resist residue and the metal oxide product derived from metal line may be hereinafter collectively referred to as ashing residue in some cases), and a method for manufacturing a semiconductor substrate or semiconductor element including the step of cleaning a semiconductor substrate or semiconductor element with the remover composition.

BACKGROUND OF THE INVENTION

In the method for manufacturing of a semiconductor element on a semiconductor substrate such as a silicon wafer, a thin film is formed by a method such as sputtering, and given patterns are formed with a resist on the thin film by lithography. The method includes the steps of etching the formed patterns as an etching resist to selectively remove the thin film in a lower layer part, forming lines, via holes and the like, and thereafter subjecting the resist obtained to ashing, thereby removing the resist. A series of these steps are repeated to give a manufactured article of a semiconductor element.

Since residue generated after the etching or ashing mentioned above can be a cause for disadvantages such as contact failure, it is earnestly desired to carry out residue removal at a high level.

Conventionally, various proposals are made on a cleaning liquid containing a fluorine-containing compound because it is effective for removing the residue as described above (for example, JP-A-Hei-9-279189, JP-A-Hei-11-67632, JP 2004-94203 A, JP 2003-68699 A).

SUMMARY OF THE INVENTION

The present invention relates to:

[1] a remover composition used for cleaning of a semiconductor substrate or semiconductor element, wherein:

(1) the remover composition contains 65% by weight or more of water;

(2) the remover composition has a pH at 20° C. of 2 or more and 6 or less; and (3) the remover composition contains:

(I) at least one member selected from the group consisting of a saccharide, an amino acid compound, an organic acid salt and an inorganic acid salt, and 0.01 to 1% by weight of ammonium hexafluorosilicate, or (II) an organic phosphonic acid and a fluorine-containing compound; and

[2] a method for manufacturing a semiconductor substrate or semiconductor element, including the step of cleaning the semiconductor substrate or semiconductor element with the remover composition as defined in the above [1].

DETAILED DESCRIPTION OF THE INVENTION

The present invention relates to a remover composition which has a low load to environments, excellent removability for resist residue generated after ashing and a metal oxide product derived from metal line (for example, aluminum-, copper- and titanium-based oxide products), particularly an aluminum-based oxide product, even under cleaning conditions of lower temperatures and a shorter period of time, and excellent corrosion resistance for metal line (particularly, metal line containing aluminum); and a method for manufacturing a semiconductor substrate or semiconductor element, including the step of cleaning a semiconductor substrate or semiconductor element with the composition.

According to the present invention, a remover composition which has a low load to environments, excellent removability for resist residue generated after ashing and a metal oxide product derived from metal line (for example, aluminum-, copper- and titanium-based oxide products), particularly an aluminum-based oxide product, even under cleaning conditions of lower temperatures and a shorter period of time, and excellent corrosion resistance for metal line (particularly, metal line containing aluminum); and a method for manufacturing a semiconductor substrate or semiconductor element, including the step of cleaning a semiconductor substrate or semiconductor element with the composition can be provided.

These and other advantages of the present invention will be apparent from the following description.

The conventional detergent containing a fluorine-containing compound disclosed in JP-A-Hei-9-279189, JP-A-Hei-11-67632, and JP 2004-94203 A is set to have a water content at a low level in order to suppress corrosion on metal line. However, when a large amount of water is used in a rinsing step or the like, the corrosion on metal line is generated. Therefore, it is necessary to carry out rinsing with a solvent such as isopropanol for suppressing the corrosion on metal line, so that there is recently an increase in demands for meeting the environmental requirement (operability, wastewater treatment and the like).

On the other hand, a proposal is also made on a detergent containing a fluorine-containing compound in which a water content is large, i.e., an aqueous detergent (e.g., JP 2003-68699 A).

In the conventional aqueous detergent containing a fluorine-containing compound, however, it is difficult to control removability and corrosion resistance, and it is found that a proposal is not made on a detergent showing satisfactory performance, particularly in the cleaning of a semiconductor element having fine line width and a requirement for a cleaning treatment at low temperatures in a shorter period of time from the viewpoint of promoting efficiency of the cleaning step as in a single wafer cleaning process explained later.

Recent manufacture of semiconductor elements shows a tendency of more limited production of diversified products. For this reason, the diameter of a silicon wafer is enlarged and the number of semiconductor elements obtained in a single manufacturing of a silicon wafer is increased, thereby lowering the cost.

However, a batch processing cleaning process conventionally used for cleaning of semiconductor substrates or semiconductor elements (process of cleaning about 25 silicon wafers in one operation) is not likely to meet the needs for more limited production of diversified products, and increase in the size of a conveying equipment accompanying silicon wafers having larger diameters is also a new problem.

For solving such a problem, a case where a single wafer cleaning process (method of cleaning one silicon wafer at a time) is employed in the cleaning of a semiconductor substrate or semiconductor element is increasing. However, how production efficiency can be maintained or improved is a problem for the single wafer cleaning process because a silicon wafer is cleaned one wafer at a time.

One of means for maintaining or improving production efficiency in the single wafer cleaning process includes a means in which the cleaning temperature is lowered and further shortens the cleaning time than those of a batch processing cleaning process, while satisfactorily keeping the detergency.

Therefore, for the purpose of maintaining or improving production efficiency, it is preferable in the single wafer cleaning process that an ashing residue can be sufficiently removed even under cleaning conditions of lower temperatures and a shorter period of time as compared to the batch processing cleaning process.

However, removability under cleaning conditions of lower temperatures and a shorter period of time such as a single wafer cleaning process is not conventionally designed, and it is found that the above problem cannot be solved only by the introduction of techniques specifically disclosed in the above publications.

In view of the above, the present inventors have found that highly excellent removability and corrosion resistance are exhibited even in an aqueous system by combining a fluorine-containing compound such as ammonium hexafluorosilicate with a specified chemical. The present invention is accomplished thereby.

One of the features of the remover composition of the present invention resides in that the remover composition is used for cleaning of a semiconductor substrate or semiconductor element, wherein:

(1) the remover composition contains 65% by weight or more of water;

(2) the remover composition has a pH at 20° C. of 2 or more and 6 or less; and (3) the remover composition contains:

(I) at least one member selected from the group consisting of a saccharide, an amino acid compound, an organic acid salt and an inorganic acid salt, and 0.01 to 1% by weight of ammonium hexafluorosilicate, or (II) an organic phosphonic acid and a fluorine-containing compound.

Here, the remover composition of the present invention that contains (I) is referred to as a remover composition of Embodiment 1, and the remover composition of the present invention containing (II) is referred to as a remover composition of Embodiment 2.

Remover Composition of Embodiment 1

The remover composition of Embodiment 1 of the present invention will be explained hereinbelow.

Water

Examples of water in the remover composition of Embodiment 1 include ultrapure water, pure water, ion-exchanged water, distilled water and the like. Ultrapure water, pure water and ion-exchanged water are preferable, ultrapure water and pure water are more preferable, and ultrapure water is even more preferable. Here, pure water and ultrapure water refer to one obtained by passing tap water through activated carbon, subjecting the resulting water to ion exchange and then distillation, and optionally irradiating the distilled product with a given amount of ultraviolet light under an ultraviolet lamp, or passing the distilled product through a filter. For example, the electric conductivity at 25° C. is, in many cases, 1 μS/cm or less for pure water, and 0.1 μS/cm or less for ultrapure water. The content of the water is 65% by weight or more, of the remover composition. The content of the water is preferably from 65 to 99.94% by weight, more preferably from 70 to 99.94% by weight, even more preferably from 80 to 99.94% by weight, and even more preferably from 90 to 99.94% by weight, of the remover composition, from the environmental viewpoint including chemical solution stability, operability, waste liquid treatment and the like.

Ammonium Hexafluorosilicate

The content of ammonium hexafluorosilicate is from 0.01 to 1% by weight of the remover composition. The content is preferably from 0.01 to 0.5% by weight, more preferably from 0.01 to 0.3% by weight, and even more preferably from 0.01 to 0.2% by weight, from the viewpoint of satisfying both removability for an ashing residue at lower temperatures in a shorter period of time and corrosion resistance for metal line in rinsing with water and stability in the manufactured article.

The remover composition of Embodiment 1 also contains at least one member selected from the group consisting of a saccharide, an amino acid compound, an organic acid salt and an inorganic acid salt. The total content of at least one member selected from the group consisting of a saccharide, an amino acid compound, an organic acid salt and an inorganic acid salt is preferably not exceeding 30% by weight, more preferably not exceeding 20% by weight, even more preferably not exceeding 10% by weight, and even more preferably not exceeding 5% by weight, of the remover composition, from the viewpoint of maintaining removability for an ashing residue and improving corrosion resistance for metal line.

Saccharide

As the saccharide in the remover composition of Embodiment 1, at least one member selected from the group consisting of a pentose such as xylose; a sugar alcohol of a pentose, such as xylitol; a hexose such as glucose; and a sugar alcohol of a hexose, such as sorbitol and mannitol is preferable, and at least one member selected from the group consisting of xylitol, glucose, sorbitol and mannitol is more preferable. The content of the saccharide is, when contained in the remover composition, preferably from 0.1 to 30% by weight, more preferably from 0.5 to 15% by weight, and even more preferably from 0.5 to 5% by weight, of the remover composition.

Amino Acid Compound

The amino acid compound in the remover composition of Embodiment 1 includes, for example, glycine, dihydroethylglycine, alanine, glycylglycine, cysteine, glutamine and the like. The content of the amino acid compound is, when contained in the remover composition, preferably from 0.05 to 10% by weight, more preferably from 0.05 to 5% by weight, and even more preferably from 0.05 to 1% by weight, of the remover composition.

Organic Acid Salt

The organic acid salt in the remover composition of Embodiment 1 includes, for example, ammonium salts of organic acids and the like, and ammonium organic phosphonate, ammonium acetate, ammonium oxalate, ammonium citrate, ammonium gluconate and ammonium sulfosuccinate are preferable. The content of the organic acid salt is, when contained in the remover composition, preferably from 0.1 to 30% by weight, more preferably from 0.5 to 15% by weight, and even more preferably from 0.5 to 5% by weight, of the remover composition.

Inorganic Acid Salt

The inorganic acid salt in the remover composition of Embodiment 1 includes, for example, ammonium salts of inorganic acids and the like, and ammonium nitrate, ammonium sulfate, ammonium phosphate, ammonium borate and ammonium chloride are preferable. The content of the inorganic acid salt is, when contained in the remover composition, preferably from 0.1 to 30% by weight, more preferably from 0.5 to 15% by weight, and even more preferably from 0.5 to 5% by weight, of the remover composition.

Regarding the total content of ammonium hexafluorosilicate and at least one member selected from the group consisting of a saccharide, an amino acid compound, an organic acid salt and an inorganic acid salt in the remover composition of Embodiment 1, the upper limit of the total content is preferably 31% by weight or less, more preferably 15.5% by weight or less, even more preferably 10.5% by weight or less, even more preferably 5.3% by weight or less, and even more preferably 1.2% by weight or less, of the remover composition, and the lower limit of the total content is preferably 0.06% by weight or more, and more preferably 0.11% by weight or more, of the remover composition, from the viewpoint of satisfying both removability for an ashing residue and corrosion resistance for metal line. The total content is preferably from 0.06 to 31% by weight, more preferably from 0.06 to 15.5% by weight, even more preferably from 0.06 to 10.5% by weight, even more preferably from 0.11 to 5.3% by weight, and even more preferably from 0.11 to 1.2% by weight, of the remover composition, from the comprehensive viewpoint.

The weight ratio of ammonium hexafluorosilicate to at least one member selected from the group consisting of a saccharide, an amino acid compound, an organic acid salt and an inorganic acid salt is preferably from 1/50 to 20/1, more preferably from 1/20 to 20/1, even more preferably from 1/10 to 10/1, and even more preferably from 1/5 to 5/1.

Water-Soluble Organic Solvent

The remover composition of Embodiment 1 preferably further contains a water-soluble organic solvent, from the viewpoint of enhancing penetrability to an ashing residue, wettability to a wafer and water-solubility and improving removability. The water-soluble organic solvent includes, for example, γ-butyrolactone, N-methylpyrrolidone, dimethylformamide, dimethyl sulfoxide, polyhydric alcohols such as ethylene glycol and propylene glycol, glycol ethers such as ethylene glycol monobutyl ether and diethylene glycol monobutyl ether, and the like. Among them, ethylene glycol and diethylene glycol monobutyl ether are preferable and diethylene glycol monobutyl ether is more preferable, from the viewpoint of further enhancing penetrability to an ashing residue, wettability to a wafer and water-solubility.

The content of the water-soluble organic solvent is preferably from 1 to 10% by weight, more preferably from 1 to 5% by weight, even more preferably from 1 to 3% by weight, and even more preferably from 1 to 2% by weight, of the remover composition, from the viewpoint of giving sufficient penetrability and wettability without lowering stability in the manufactured article.

Oxidizing Agent

The remover composition of Embodiment 1 preferably further contains an oxidizing agent, from the viewpoint of improving removability for an ashing residue derived from titanium nitride. The oxidizing agent includes, for example, inorganic peroxides such as hydrogen peroxide, ozone, hypochlorous acid, and perchloric acid, and the like. Among them, hydrogen peroxide is preferable from the viewpoint of further improving removability for an ashing residue derived from titanium nitride.

The content of the oxidizing agent is preferably from 0.5 to 5% by weight, more preferably from 0.5 to 3% by weight, and even more preferably from 1 to 2% by weight, of the remover composition, from the viewpoint of satisfactorily obtaining removability for an ashing residue derived from titanium nitride.

Ammonium Fluoride

The remover composition of Embodiment 1 may further contain ammonium fluoride from the viewpoint of improving removability for an ashing residue derived from an interlayer film. The content of ammonium fluoride is preferably from 0.01 to 1% by weight, and more preferably from 0.1 to 1% by weight, of the remover composition, from the viewpoint of satisfactorily obtaining removability for an ashing residue derived from an interlayer film.

In addition, the remover composition of Embodiment 1 may contain an organic phosphonic acid, from the viewpoint of exhibiting excellent corrosion resistance for metal line under wide operating conditions such as temperature and time. The organic phosphonic acid is contained in an amount of preferably from 0.05 to 10% by weight, more preferably from 0.05 to 5% by weight, even more preferably from 0.1 to 3% by weight, even more preferably from 0.1 to 1% by weight, and even more preferably from 0.1 to 0.5% by weight, of the remover composition. Specific examples of the organic phosphonic acid include the organic phosphonic acids which can be used in the remover composition of Embodiment 2 given later.

In addition, the remover composition of Embodiment 1 may contain a fluorine-containing compound excluding ammonium hexafluorosilicate and ammonium fluoride, from the viewpoint of satisfying both removability of ashing residue at low temperatures and a short time period and excellent corrosion resistance for metal line during rinsing with water, and stability of the manufactured article. The fluorine-containing compound is contained in an amount of preferably from 0.01 to 1% by weight, more preferably from 0.01 to 0.5% by weight, even more preferably from 0.01 to 0.3% by weight, and even more preferably from 0.01 to 0.2% by weight, of the remover composition. Specific examples of the fluorine-containing compound include hydrofluoric acid, ammonium hexafluorophosphate, an alkylamine hydrofluoride, an alkanolamine hydrofluoride, a tetraalkylammonium fluoride and the like.

pH

The pH at 20° C. of the remover composition of Embodiment 1 is preferably 2 or more and 6 or less, more preferably 2 or more and less than 6, and even more preferably 2 or more and 5.7 or less, from the viewpoint of satisfying both removability for an ashing residue at lower temperatures in a shorter period of time and corrosion resistance for metal line. The pH can be adjusted by adding, for example, an organic acid such as acetic acid or oxalic acid, an inorganic acid such as sulfuric acid or nitric acid, an amine such as an amino alcohol or an alkylamine, ammonia or the like. The pH at 20° C. can be determined by any methods known in the art.

Preparation Process

The remover composition of Embodiment 1 can be prepared by mixing at least one member selected from the group consisting of a saccharide, an amino acid compound, an organic acid salt and an inorganic acid salt, and ammonium hexafluorosilicate and the like with the above-mentioned water by a known method. The remover composition of the present invention thus obtained can not only remove almost all of ashing residue but also has excellent corrosion resistance for metal line, particularly, metal line containing aluminum, even in cleaning at lower temperatures and in a shorter period of time such as a single wafer cleaning method.

Remover Composition of Embodiment 2

The remover composition of Embodiment 2 of the present invention will be explained hereinbelow.

Water

The water in the remover composition of Embodiment 2 may be the same ones as those used in the remover composition of Embodiment 1. The content of the water is 65% by weight or more, of the remover composition. The content of the water is preferably from 65 to 99.89% by weight, more preferably from 70 to 99.89% by weight, even more preferably from 85 to 99.89% by weight, and even more preferably from 90 to 99.89% by weight, of the remover composition, from the environmental viewpoint including chemical solution stability, operability, waste liquid treatment and the like.

Fluorine-Containing Compound

In the remover composition of Embodiment 2, the fluorine-containing compound has an action of dissolving an ashing residue at lower temperatures in a shorter period of time, and the like. The fluorine-containing compound includes, for example, hydrofluoric acid, ammonium hexafluorosilicate, ammonium fluoride, ammonium hexafluorophosphate, an alkylamine hydrofluoride, an alkanolamine hydrofluoride, a tetraalkylammonium fluoride and the like. Among them, ammonium hexafluorosilicate and ammonium fluoride are preferable from the viewpoint of satisfying both removability for an ashing residue at lower temperatures in a shorter period of time and corrosion resistance for metal line. These fluorine-containing compounds can be used alone or in admixture of two or more kinds.

The content of the fluorine-containing compound is preferably from 0.01 to 1% by weight, more preferably from 0.01 to 0.5% by weight, even more preferably from 0.01 to 0.3% by weight, and even more preferably from 0.01 to 0.2% by weight, of the remover composition, from the viewpoint of satisfying both removability for an ashing residue at lower temperatures in a shorter period of time and corrosion resistance for metal line in rinsing with water, and stability in the manufactured article.

Organic Phosphonic Acid

In the remover composition of Embodiment 2, the organic phosphonic acid has an action of corrosion resistance for metal line, and the like. The organic phosphonic acid includes methyldiphosphonic acid, aminotri(methylenephosphonic acid), ethylidenediphosphonic acid, 1-hydroxyethylidene-1,1-diphosphonic acid, 1-hydroxypropylidene-1,1-diphosphonic acid, 1-hydroxybutylidene-1,1-diphosphonic acid, ethylaminobis(methylenephosphonic acid), 1,2-propylenediaminetetra(methylenephosphonic acid), dodecylaminobis(methylenephosphonic acid), nitrotris(methylenephosphonic acid), ethylenediaminebis(methylenephosphonic acid), ethylenediaminetetra(methylenephosphonic acid), hexenediaminetetra(methylenephosphonic acid), diethylenetriaminepenta(methylenephosphonic acid), cyclohexanediaminetetra(methylenephosphonic acid) and the like. Among them, aminotri(methylenephosphonic acid), 1-hydroxyethylidene-1,1-diphosphonic acid and ethylenediaminetetra(methylenephosphonic acid) are preferable from the viewpoint of having excellent corrosion resistance for metal line. These organic phosphonic acids can be used alone or in admixture of two or more kinds.

The content of the organic phosphonic acid is preferably from 0.05 to 10% by weight, more preferably from 0.05 to 5% by weight, even more preferably from 0.1 to 3% by weight, even more preferably from 0.1 to 1% by weight, and even more preferably from 0.1 to 0.5% by weight, of the remover composition, from the viewpoint of exhibiting excellent corrosion resistance for metal line under wide operable conditions (temperature, time and the like).

Regarding the total content of the fluorine-containing compound and organic phosphonic acid in the remover composition of Embodiment 2, the upper limit of the total content is preferably 11% by weight or less, more preferably 5.5% by weight or less, even more preferably 3.3% by weight less, and even more preferably 1.2% by weight or less, of the remover composition, and the lower limit of the total content is preferably 0.06% by weight or more, and more preferably 0.11% by weight or more, of the remover composition, from the viewpoint of satisfying both removability for an ashing residue and corrosion resistance for metal line. The total content is preferably from 0.06 to 11% by weight, more preferably from 0.06 to 5.5% by weight, even more preferably from 0.11 to 3.3% by weight, and even more preferably from 0.11 to 1.2% by weight, of the remover composition, from the comprehensive viewpoint.

The weight ratio of the fluorine-containing compound to the organic phosphonic acid is preferably from 1/20 to 20/1, more preferably from 1/10 to 10/1, and even more preferably from 1/5 to 5/1.

Water-Soluble Organic Solvent

The remover composition of Embodiment 2 preferably further contains a water-soluble organic solvent, from the viewpoint of enhancing penetrability to an ashing residue, wettability to a wafer and water-solubility and improving removability. The water-soluble organic solvent and its content may be the same as those used in the remover composition of Embodiment 1.

Oxidizing Agent

The remover composition of Embodiment 2 preferably further contains an oxidizing agent from the viewpoint of improving removability for an ashing residue derived from titanium nitride. The oxidizing agent and its content may be the same as those used in the remover composition of Embodiment 1.

Surfactant

The remover composition of Embodiment 2 may further contain a surfactant within the range so as not to impair the effects of the present invention. The surfactant includes anionic surfactants such as fatty acid salts, alkyl sulfates, alkylbenzenesulfonates, polyoxyethylene alkyl ether sulfates, and dialkyl sulfosuccinates; cationic surfactants such as alkylamine acetates and quaternary ammonium salts; amphoteric surfactants such as alkyl dimethylaminoacetate betaines and alkyl dimethylamine oxides; nonionic surfactants such as glycerol fatty acid esters, propylene glycol fatty acid esters, polyoxyethylene alkyl ethers, polyoxyethylene polyoxypropylene ethers and the like.

The content of the surfactant is preferably from 0.01 to 10% by weight, more preferably from 0.1 to 5% by weight, and even more preferably from 0.5 to 3% by weight, of the remover composition, from the viewpoint of improving removability for an ashing residue.

In addition, the remover composition of the Embodiment 2 may contain at least one member selected from the group consisting of a saccharide, an amino acid compound, an organic acid salt and an inorganic acid salt, from the viewpoint of exhibiting excellent corrosion resistance for metal line under wide operating conditions such as temperature and time. As the content of the component, the saccharide is contained in an amount of preferably from 0.1 to 30% by weight, more preferably from 0.5 to 15% by weight, and even more preferably from 0.5 to 5% by weight, of the remover composition; the amino acid compound is contained in an amount of preferably from 0.05 to 10% by weight, more preferably from 0.05 to 5% by weight, and even more preferably from 0.05 to 1% by weight, of the remover composition; the organic acid salt is contained in an amount of preferably from 0.1 to 30% by weight, more preferably from 0.5 to 15% by weight, and even more preferably from 0.5 to 5% by weight, of the remover composition; and the inorganic acid salt is contained in an amount of preferably from 0.1 to 30% by weight, more preferably from 0.5 to 15% by weight, and even more preferably from 0.5 to 5% by weight, of the remover composition. At least one member selected from the group consisting of the saccharide, the amino acid compound, the organic acid salt, and the inorganic acid salt is contained in a total amount of preferably not exceeding 30% by weight, more preferably not exceeding 20% by weight, even more preferably not exceeding 10%, and even more preferably not exceeding 5% by weight, of the remover composition, from the viewpoint of maintaining removability for ashing residue and improving corrosion resistance for metal line. Specific examples of the saccharide, the amino acid compound, the organic acid salt and the inorganic acid salt include the saccharide, the amino acid compound, the organic acid salt and the inorganic acid salt which can be used in the remover composition of the Embodiment 1 mentioned above.

pH

The pH at 20° C. of the remover composition of Embodiment 2 may be also the same as that of the remover composition of Embodiment 1, from the viewpoint of satisfying both removability for an ashing residue at lower temperatures in a shorter period of time and corrosion resistance for metal line. Also, the method of adjusting the pH is as described above.

Preparation Process

The remover composition of Embodiment 2 can be prepared by mixing the organic phosphonic acid, the fluorine-containing compound and the like mentioned above with the above-mentioned water by a known method. The remover composition of the present invention thus obtained can not only remove away almost all of ashing residue, particularly an aluminum-based oxide product, but also has excellent corrosion resistance for metal line, particularly, metal line containing aluminum, even in cleaning at lower temperatures and in a shorter period of time such as a single wafer cleaning process.

Manufacturing Method

The present invention also provides a method for manufacturing a semiconductor substrate or semiconductor element including the step of cleaning a semiconductor substrate or semiconductor element with the remover composition of Embodiment 1 or Embodiment 2. In the step of cleaning, an immersion cleaning method, a shake cleaning method, a paddle cleaning method, a cleaning method by spraying in air or liquid, a cleaning method using ultrasonic wave, or the like, can be applied. Representative examples of the cleaning process of a semiconductor substrate or semiconductor element are a batch processing cleaning method including the step of cleaning about 25 silicon wafers in one operation, a single wafer cleaning method including the step of cleaning a silicon wafer one at a time, and the like. It is preferable that the remover composition of the present invention is used particularly in cleaning by a single wafer cleaning method. On the other hand, when the remover composition of the present invention is used in cleaning by a batch processing cleaning method, satisfactory removability is obtained at lower temperatures in a shorter period of time, so that it is unnecessary to clean an object for a long period of time as in a conventional method, thereby exhibiting effects such as energy saving and improvement in production efficiency.

While an excellent removability is obtained even at lower temperatures of about 20° C., the cleaning temperature is preferably from 20° to 50° C., and more preferably from 20° to 40° C. from the viewpoint of removability for an ashing residue, corrosion resistance for metal line, safety and operability.

The cleaning time is preferably from 10 seconds to 5 minutes, more preferably from 0.5 to 3 minutes, even more preferably from 0.5 to 2 minutes, and even more preferably from 0.5 to 1 minute from the viewpoint of removability for an ashing residue, corrosion resistance for metal line, safety and operability.

In the rinsing after cleaning, rinsing with water can be performed. Since a conventional ammonium fluoride-based remover or amine (such as hydroxylamine)-based remover is a solvent-based remover, the remover cannot easily be rinsed away with water, and mixing the remover with water may possibly cause corrosion of metal line, particularly metal line containing aluminum or the like, so that a method for rinsing with a solvent such as isopropanol is generally employed for the above remover. However, since the remover composition of the present invention has the features of being an aqueous system and containing an organic phosphonic acid or at least one member selected from the group consisting of a saccharide, an amino acid compound, an organic acid salt and an inorganic acid salt having an action of corrosion resistance for metal line, particularly metal line containing aluminum, the resistance for corrosion of metal line, particularly metal line containing aluminum is high even when water is in excess. Accordingly, rinsing with water can be performed in the step of cleaning included in the manufacturing method of the present invention, whereby exhibiting effects that load on environments is extremely small and the process is economical.

The semiconductor substrate or semiconductor element thus manufactured contains hardly any ashing residue and shows very low corrosion of metal line, particularly metal line containing aluminum.

The remover composition of Embodiment 1 or Embodiment 2 of the present invention is suitable for manufacture of a semiconductor substrate or semiconductor element having metal line containing aluminum, copper, tungsten, titanium or the like, and particularly suitable for manufacture of a semiconductor substrate or semiconductor element having metal line containing aluminum since the composition shows excellent removability for aluminum-, copper- and titanium-based oxide products and has excellent corrosion resistance for metal line containing aluminum. Among them, since the remover composition of Embodiment 2 has even more excellent corrosion resistance for metal line containing aluminum, the remover composition is even more suitable for the manufacture of a semiconductor substrate or semiconductor element having metal line containing aluminum.

Since the remover composition of Embodiment 1 or Embodiment 2 of the present invention has excellent corrosion resistance for metal line, particularly metal line containing aluminum, the remover composition can also be suitably used for manufacture of a semiconductor substrate or semiconductor element having a metal line width of preferably 0.25 μm or less, more preferably 0.18 μm or less, even more preferably 0.13 μm or less

EXAMPLES

The following examples further describe and demonstrate embodiments of the present invention. The examples are given solely for the purposes of illustration and are not to be construed as limitations of the present invention.

1. Preparation of Wafer for Evaluation

Each of an unclean patterned wafer A (Al line) having aluminum (Al) line with a line width of 0.25 μm and an unclean patterned wafer B (via holes) in which a via hole of a diameter of 0.25 μm was formed was diced into squares having a side of 1 cm each and used as wafers for evaluation. Here, the patterned wafers A and B each had a structure described below, Structure of Patterned Wafer A
TiN/Al—Cu/TiN/$SiO_2$/substrate Structure of Patterned Wafer B
$SiO_2$(insulation layer)/TiN(barrier layer)/Al—Cu(electroconductive layer)/TiN/substrate
Here, a barrier layer is etched at the via hole.

2. Preparation of Remover Composition

Each of the components was added and mixed so as to give each of compositions shown in Tables 1 and 2 (numerical value being expressed as % by weight), to prepare each of remover compositions of Examples I-1 to I-10 and II-1 to II-9 and Comparative Examples I-1 to I-5.

3. Detergency Test

The wafer for evaluation prepared in the item 1. was immersed in 30 ml of the remover composition prepared in the item 2. at 25° C. for 1 minute. Thereafter, the wafer for evaluation was taken out from the remover composition, and immersed in 30 ml of ultrapure water at 25° C. for 30 seconds. This immersion procedure in the ultrapure water was repeated twice, and the wafer for evaluation was then dried by blowing a nitrogen gas thereto, to give an observation sample.

[Removability and Corrosion Resistance]

The observation sample was observed with a FE-SEM (scanning electron microscope) at a magnification of from 50,000 to 100,000. Removability and corrosion resistance were evaluated on Al line and an ashing residue or an ashing residue in a via hole by comparing the wafer for evaluation of the observation sample with that before the detergency test according to the following evaluation criteria. The results are shown in Tables 1 and 2. Those evaluated as ◎ or ○ for both removability and corrosion resistance are acceptable products.

[Evaluation Criteria]

(Removability for Ashing Residue)
◎: The remaining of residue is not confirmed at all.
○: The residue is partly remaining.
Δ: Greater portion of residue is remaining.
X: The residue cannot be removed.

(Corrosion Resistance for Al Line)
◎: The corrosion of Al line is not confirmed at all.
○: The corrosion of Al line is partly generated.
Δ: The corrosion of Al line is generated in the majority of Al line.
X: The corrosion of Al line is generated entirely.

TABLE 1

| | Examples | | | | | | | | | | Comparative Examples | | | | |
|---|---|---|---|---|---|---|---|---|---|---|---|---|---|---|---|
| | I-1 | I-2 | I-3 | I-4 | I-5 | I-6 | I-7 | I-8 | I-9 | I-10 | I-1 | I-2 | I-3 | I-4 | I-5 |
| Components for Remover Composition (% by weight) | | | | | | | | | | | | | | | |
| Ammonium Hexafluorosilicate | 0.02 | 0.05 | 0.05 | 0.05 | 0.05 | 0.05 | 0.05 | 0.05 | 0.05 | 0.05 | — | — | — | 3.0 | 0.05 |
| Ammonium Fluoride | — | — | — | — | — | — | — | — | — | 0.5 | 0.5 | — | 0.1 | — | — |
| HEDP*1 | 0.1 | 0.1 | 0.5 | — | — | — | — | 0.1 | 0.1 | 0.1 | — | — | — | — | — |
| Acetic Acid | — | — | — | — | — | — | — | — | — | — | — | — | — | — | 1.0 |
| Sorbitol | — | — | — | 1.0 | — | — | — | — | — | — | — | — | — | 5.0 | — |
| Glycine | — | — | — | — | 0.1 | — | — | — | — | — | — | — | — | — | — |
| Ammonium Acetate | — | — | — | — | — | 1.0 | — | — | — | — | — | — | — | — | — |
| Ammonium Sulfate | — | — | — | — | — | — | 1.0 | — | — | — | — | — | — | — | — |
| Diethylene Glycol Monobutyl Ether | — | — | — | — | — | — | — | 2.0 | 2.0 | 2.0 | — | — | — | — | — |
| Hydrogen Peroxide | — | — | — | — | — | — | — | — | — | 1.0 | — | — | — | — | — |
| 1,2-Propanediamine*2 | — | — | — | — | — | — | — | — | 0.02 | — | — | — | — | — | — |
| Dimethylformamide | — | — | — | — | — | — | — | — | — | — | 75.0 | — | — | — | — |
| Hydroxylamine | — | — | — | — | — | — | — | — | — | — | — | 20.0 | — | — | — |
| 2-Amino-2-ethoxyethanol | — | — | — | — | — | — | — | — | — | — | — | 55.0 | — | — | — |
| N-Methyldiethanolamine | — | — | — | — | — | — | — | — | — | — | — | — | — | 20.0 | — |
| Catechol | — | — | — | — | — | — | — | — | — | — | — | 5.0 | — | — | — |
| Dimethyl Sulfoxide | — | — | — | — | — | — | — | — | — | — | — | — | 49.0 | — | — |
| Diethylene Glycol Monomethyl Ether | — | — | — | — | — | — | — | — | — | — | — | — | 21.0 | — | — |
| Dipropylene Glycol Monomethyl Ether | — | — | — | — | — | — | — | — | — | — | — | — | — | 10.0 | — |
| Methylenediphosphonic Acid | — | — | — | — | — | — | — | — | — | — | — | — | 5.0 | — | — |
| N,N-Diethylethanolamine | — | — | — | — | — | — | — | — | — | — | — | — | 1.5 | — | — |
| Ultrapure Water | 99.88 | 99.85 | 99.45 | 98.95 | 99.85 | 98.95 | 98.95 | 97.85 | 96.83 | 96.35 | 24.5 | 20.0 | 23.4 | 62.0 | 98.95 |
| Properties | | | | | | | | | | | | | | | |
| pH*3 | 2.6 | 2.6 | 2.0 | 3.3 | 3.5 | 5.7 | 3.5 | 2.5 | 3.8 | 5.5 | 9.8 | 11.7 | 3.0 | 10.4 | 2.8 |
| Removability of Ashing Residue (Wafer A) | ○ | ◎ | ◎ | ◎ | ◎ | ◎ | ◎ | ◎ | ◎ | ◎ | ◎ | X | ○ | ◎ | ◎ |

TABLE 1-continued

| | Examples | | | | | | | | | | Comparative Examples | | | | |
|---|---|---|---|---|---|---|---|---|---|---|---|---|---|---|---|
| | I-1 | I-2 | I-3 | I-4 | I-5 | I-6 | I-7 | I-8 | I-9 | I-10 | I-1 | I-2 | I-3 | I-4 | I-5 |
| Corrosion Resistance for Al Line (Wafer A) | ◎ | ◎ | ◎ | ○ | ○ | ○ | ○ | ◎ | ◎ | ○ | X | ○ | Δ | X | X |
| Removability of Ashing Residue (Wafer B) | ○ | ○ | ○ | ○ | ○ | ○ | ○ | ○ | ○ | ◎ | X | Δ | X | ○ | ○ |

*1HEDP is 1-hydroxyethylidene-1,1-diphosphonic acid.
*21,2-Propanediamine was added for adjusting pH of the composition.
*3The pH is a value found at 20° C.

TABLE 2

| | Examples | | | | | | | | |
|---|---|---|---|---|---|---|---|---|---|
| | II-1 | II-2 | II-3 | II-4 | II-5 | II-6 | II-7 | II-8 | II-9 |
| Components for Remover Composition (% by weight) | | | | | | | | | |
| Ammonium Fluoride | 0.05 | | 0.2 | 0.2 | 0.2 | 0.2 | 0.2 | | |
| Ammonium Hexafluorosilicate | | 0.05 | | | | | 0.05 | 0.05 | 0.05 |
| 1-Hydroxyethylidene-1,1-diphosphonic acid | 0.1 | 0.1 | 0.1 | | | 0.1 | | | |
| Aminotri(methylenephosphonic acid) | | | | 0.1 | 0.3 | | 0.1 | 0.1 | 0.1 |
| Methylenediphosphonic acid | | | | | | | | | |
| Difmethylformamide | | | | | | | | | |
| Catechol | | | | | | | | | |
| Sorbitol | | | | | | | | | |
| Diethylene Glycol Monobutyl Ether | | | | | | 2.0 | 2.0 | 2.0 | |
| Dimethyl Sulfoxide | | | | | | | | | |
| Diethylene Glycol Monomethyl Ether | | | | | | | | | |
| Dipropylene Glycol Monomethyl Ether | | | | | | | | | |
| Hydrogen Peroxide | | | | | | | 1.0 | | |
| Ultrapure Water | 99.85 | 99.85 | 99.7 | 99.7 | 99.5 | 97.7 | 96.65 | 97.83 | 99.81 |
| 1,2-Propanediamine | | | | | | | | 0.02 | |
| 28% (by weight) Aqueous Ammonia | | | | | | | | | 0.04 |
| Hydroxylamine | | | | | | | | | |
| 2-Amino-2-ethoxyethanol | | | | | | | | | |
| N-Methyldiethanolamine | | | | | | | | | |
| N,N-Diethylethanolamine | | | | | | | | | |
| Properties | | | | | | | | | |
| pH*1 | 3.5 | 2.6 | 4.6 | 4.7 | 4.4 | 4.7 | 5.0 | 3.8 | 4.0 |
| Removability of Ashing Residue (Wafer A) | ○ | ◎ | ◎ | ◎ | ◎ | ◎ | ◎ | ◎ | ◎ |
| Corrosion Resistance for Al Line (Wafer A) | ◎ | ◎ | ◎ | ◎ | ◎ | ◎ | ○ | ◎ | ◎ |
| Removability of Ashing Residue (Wafer B) | ○ | ○ | ○ | ○ | ○ | ○ | ◎ | ○ | ○ |

*1The pH is a value found at 20° C.

It can be seen from the results in Table 1 and Table 2 that all of the remover compositions obtained in Examples I-1 to I-10 and II-1 to II-9 show excellent removability for an ashing residue and excellent corrosion resistance for Al line as compared to those obtained in Comparative Examples I-1 to I-5 even at lower temperatures in a shorter period of time.

The remover composition of the present invention has excellent removability for a resist residue generated during the formation of a semiconductor element and a metal oxide product derived from metal line, particularly an aluminum-based oxide product at lower temperatures and in a shorter period of time, and also has excellent corrosion resistance for metal line, particularly metal line containing aluminum. Therefore, by using the remover composition of the present invention, effects such as a recent requirement for more limited production of diversified semiconductor elements can be satisfied, speeding up and higher degree of integration of semiconductor elements can be accomplished, and high-quality electronic parts such as LCD, memory, and CPU can be manufactured are exhibited.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A remover composition used for cleaning of a semiconductor substrate or semiconductor element, wherein:

(1) the remover composition comprises 65% by weight or more of water; and (2) the remover composition has a pH at 20° C. of 2 or more and 6 or less; and (3) the remover composition comprises:

(I) at least one member selected from the group consisting of a saccharide, an amino acid compound, an organic acid salt and an inorganic acid salt, and 0.01 to 1% by weight of ammonium hexafluorosilicate, or (II) an organic phosphonic acid and a fluorine-containing compound.

2. The remover composition according to claim 1, wherein the saccharide is at least one member selected from the group consisting of pentoses, hexoses and sugar alcohols thereof.

3. The remover composition according to claim 1, wherein the amino acid compound is at least one member selected from the group consisting of glycine, dihydroxyethylglycine, alanine, glycylglycine, cysteine and glutamine.

4. The remover composition according to claim 1, wherein the organic acid salt is at least one member selected from the group consisting of ammonium organic phosphonate, ammonium acetate, ammonium oxalate, ammonium citrate, ammonium gluconate and ammonium sulfosuccinate.

5. The remover composition according to claim 1, wherein the inorganic acid salt is at least one member selected from the group consisting of ammonium nitrate, ammonium sulfate, ammonium phosphate, ammonium borate and ammonium chloride.

6. The remover composition according to claim 1, wherein the fluorine-containing compound is ammonium hexafluorosilicate.

7. The remover composition according to claim 1, wherein the organic phosphonic acid is at least one member selected from the group consisting of aminotri(methylenephosphonic acid), 1-hydroxyethylidene-1,1-diphosphonic acid and ethylenediaminetetra(methylenephosphonic acid).

8. The remover composition according to claim 1, further comprising a water-soluble organic solvent.

9. The remover composition according to claim 1, further comprising an oxidizing agent.

10. The remover composition according to claim 8, further comprising an oxidizing agent.

11. A method for manufacturing a semiconductor substrate or semiconductor element, comprising the step of cleaning the semiconductor substrate or semiconductor element with the remover composition as defined in claim 1.

12. The method according to claim 11, wherein the step of cleaning a semiconductor substrate or semiconductor element is carried out according to a single wafer cleaning process.

13. The method according to claim 11, wherein the step of cleaning a semiconductor substrate or semiconductor element is carried out at a cleaning temperature of from 20° to 50° C. for a cleaning time of from 10 seconds to 5 minutes.

14. The method according to claim 11, wherein the semiconductor substrate or semiconductor element comprises a metal line containing aluminum.

* * * * *

UNITED STATES PATENT AND TRADEMARK OFFICE

CERTIFICATE OF CORRECTION

PATENT NO. : 7,521,407 B2
APPLICATION NO. : 11/289457
DATED : April 21, 2009
INVENTOR(S) : Atsushi Tamura It is certified that error appears in the above-identified patent and that said Letters Patent is hereby corrected as shown below:

Title page, item (73) Assignee:

"KAO Corporation, Tokyo (JP)" should read --Kao Corporation, Tokyo (JP)--

Signed and Sealed this

Fifteenth Day of September, 2009

David J. Kappos

David J. Kappos
*Director of the United States Patent and Trademark Office*